US006018912A

United States Patent [19]

Baughman et al.

[11] Patent Number: 6,018,912

[45] Date of Patent: Feb. 1, 2000

[54] VEHICLE LIFTGATE COUNTER BALANCE SYSTEM

[75] Inventors: Robert Wayne Baughman, Mt. Clemens; David Joseph Chapman, Sterling Heights; Michael Antonio Ciavaglia, Dearborn, all of Mich.

[73] Assignee: General Motors Corporation, Detroit, Mich.

[21] Appl. No.: 09/106,053

[22] Filed: Jun. 26, 1998

[51] Int. Cl.[7] ..... E05F 1/10

[52] U.S. Cl. ..... 49/386; 296/56

[58] Field of Search ..... 49/386, 501; 16/289, 16/308; 296/146.4, 76, 56

[56] References Cited

U.S. PATENT DOCUMENTS

| | | | |
|---|---|---|---|
| 2,195,426 | 4/1940 | Ronning | 292/276 |
| 3,422,572 | 1/1969 | Pollak | 49/280 |
| 3,438,152 | 4/1969 | Cadiou | 49/386 |
| 3,490,756 | 1/1970 | Spier | 49/386 X |
| 3,516,210 | 6/1970 | Jentoft et al. | 49/386 X |
| 3,713,472 | 1/1973 | Dozois | 160/189 |
| 4,133,074 | 1/1979 | Schack | 49/386 X |
| 4,739,585 | 4/1988 | Pickles | 49/280 |
| 4,851,742 | 7/1989 | Chapman | 318/286 |
| 5,448,856 | 9/1995 | Moore et al. | 49/340 |
| 5,531,498 | 7/1996 | Kowall | 296/146.4 |
| 5,588,258 | 12/1996 | Wright et al. | 49/340 |
| 5,787,549 | 8/1998 | Soderland | 49/386 X |

*Primary Examiner*—Jerry Redman
*Attorney, Agent, or Firm*—Kathryn A. Marra

[57] ABSTRACT

The counter balance system for a vehicle liftgate includes a pair of gas cylinders in combination with a torsion rod. The gas cylinders urge the liftgate toward an open position but due to a short moment arm do not exert sufficient force to open the liftgate until the liftgate has pivoted about one third of the distance from the closed position toward the open position. The torsion rod also urges the liftgate toward an open position. Maximum force is exerted by the torsion rod when the liftgate is closed. As the liftgate moves toward an open position, the force exerted by the torsion rod decreases until the liftgate is midway between closed and open. The torque rod does not exert any force on the liftgate during the last portion of its movement to an open position.

2 Claims, 2 Drawing Sheets

VEHICLE LIFTGATE COUNTER BALANCE SYSTEM

TECHNICAL FIELD

This invention relates to a counter balance system for a vehicle liftgate that is pivotally attached to a vehicle compartment for pivotal movement about a generally horizontal axis and more particularly to a counter balance system that will move a liftgate from a closed position to a fully open position and that requires about the same force to hold the liftgate in a fixed position any place along the liftgate's path of travel.

BACKGROUND OF THE INVENTION

Utility vehicles and vans with liftgates that are hinged at the top about a generally horizontal axis are used by large numbers of people today. Some of these liftgates are large and heavy. Their size and weight make some liftgates difficult to open and close. Some of the liftgates are also a great distance above the ground when they are fully opened. Their height above the ground makes them very difficult for some people to close. For these and other reasons many people would like to have a power liftgate opener and closer.

A number of different liftgate openers have been tried in recent years. Some of these liftgate openers have a single cable that opens and closes a liftgate. Liftgates with a single cable opener and closer are generally trunk lids that are lightweight and have a relatively small range of movement.

Liftgates that have two or more gas cylinders for a counter balance system are common. These gas cylinders generally occupy a position in which their axis is substantially parallel to the liftgate so that the gas cylinders are hidden when the liftgate is closed. In this closed position the moment arm of the gas cylinders is quite small. With such systems the lift gate may move about one-third of their total travel range before the gas cylinders exert sufficient force to open a liftgate further without the application of an independent lifting force. There are even some systems in which the gas cylinders pass over center and bias a liftgate toward a closed position when the liftgate is closed. With these self locking systems a liftgate may need to be more than one-third open before the gas cylinders will open the liftgate further.

The force required to hold a liftgate in a given position along its path of movement from a closed position to a fully open position varies substantially in some liftgate opening systems. A power liftgate closer must exert sufficient force to hold a liftgate in any given position along the path of movement, plus the force to overcome friction, and plus the force required to accelerate the liftgate during liftgate closing. If the total force exerted by the liftgate power closure varies substantially from one position between fully opened and closed to another position between fully opened and closed, it may be difficult for the control system to detect an obstruction and stop the liftgate without incurring damage to the vehicle or to the object that obstructs the liftgate.

SUMMARY OF THE INVENTION

An object of the invention is to provide a vehicle liftgate counter balance system which can move a liftgate from a closed position to a fully opened position. Another object of the invention is to provide two separate counter balances system that cooperate with each other to provide a more uniform force to be overcome during movement of a liftgate toward a closed position. A further object of the invention is to provide a vehicle liftgate counter balance system that absorbs energy and reduces the load on latches and structures that support latches as a liftgate reaches the closed position.

The vehicle liftgate counter balance system includes a pair of gas cylinders and a torsion bar. The gas cylinders exert sufficient force on the liftgate to move the liftgate to the fully opened position during the last two-thirds of the liftgate movement to the open position. During the first third of the liftgate movement from the closed position to the open position, the gas cylinders exert insufficient force on the liftgate to move the liftgate toward the open position due to a short moment arm.

A torsion bar with rod sections, that are concentric with the pivot axis of the liftgate urge the liftgate from the closed position toward the open position during about the first 40° of pivotal movement from the closed position. The torsion bar exerts maximum torque on the liftgate when the liftgate is closed. The torque exerted by the torque rod on the liftgate decreases as the liftgate moves from the closed position. After about 40° of pivotal movement from the closed position, the torque exerted on the liftgate by the torsion bar decreases to zero. The force exerted on the liftgate by the gas cylinders increases as the liftgate is opened. After about 30° of movement the gas cylinders exert sufficient force to move the liftgate toward the fully open position. The torque bar is still exerting force on the liftgate for about another 10° of movement to assist the gas cylinders.

BRIEF DESCRIPTION OF THE DRAWINGS

The presently preferred embodiment of the invention is disclosed in the following description and in the accompanying drawings, wherein.

DETAILED DESCRIPTION OF THE PREFERRED EMBODIMENT

Figure 1:
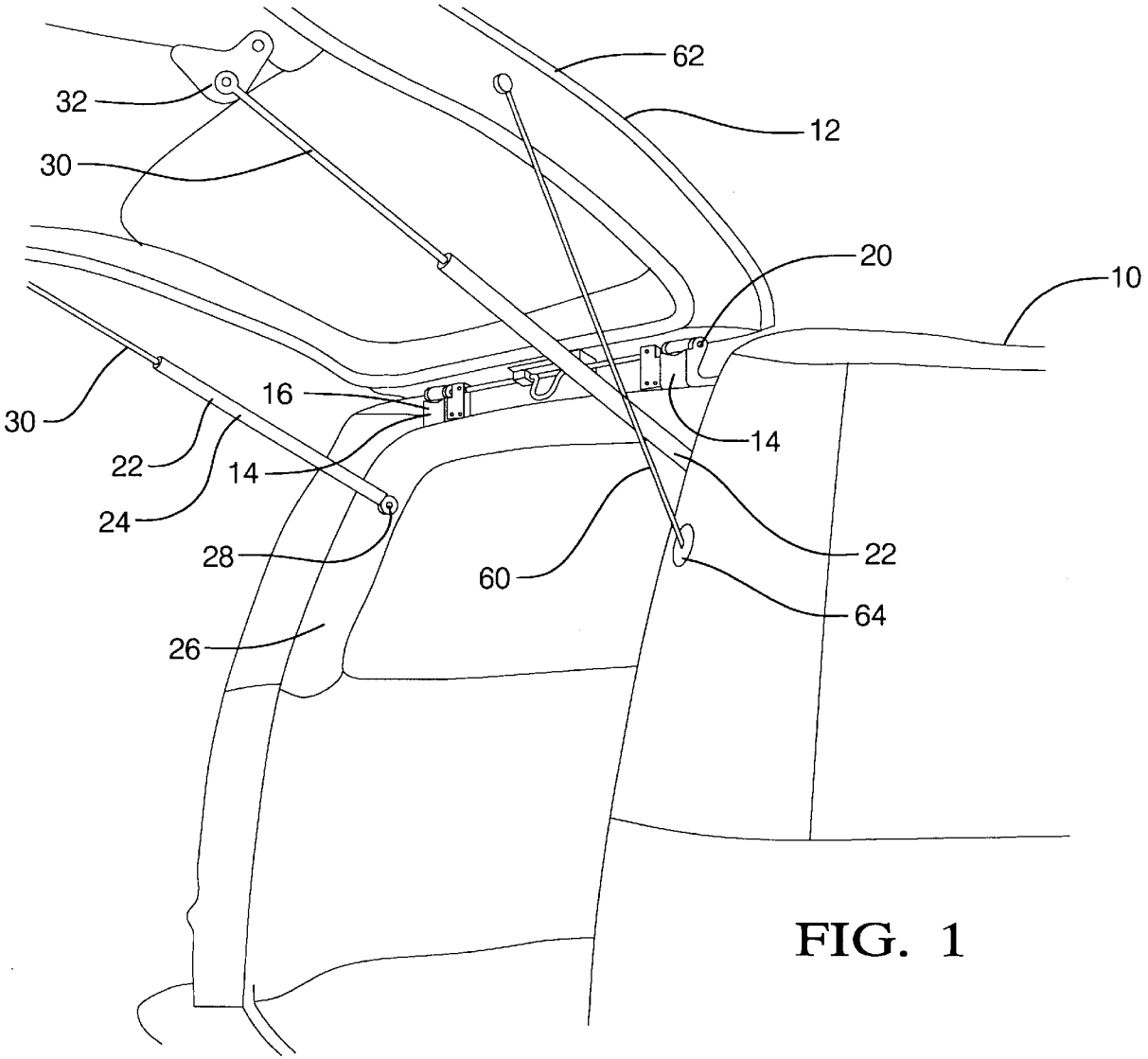
FIG. 1 is a perspective view of the rear portion of a vehicle with an open liftgate.
Figure 2:
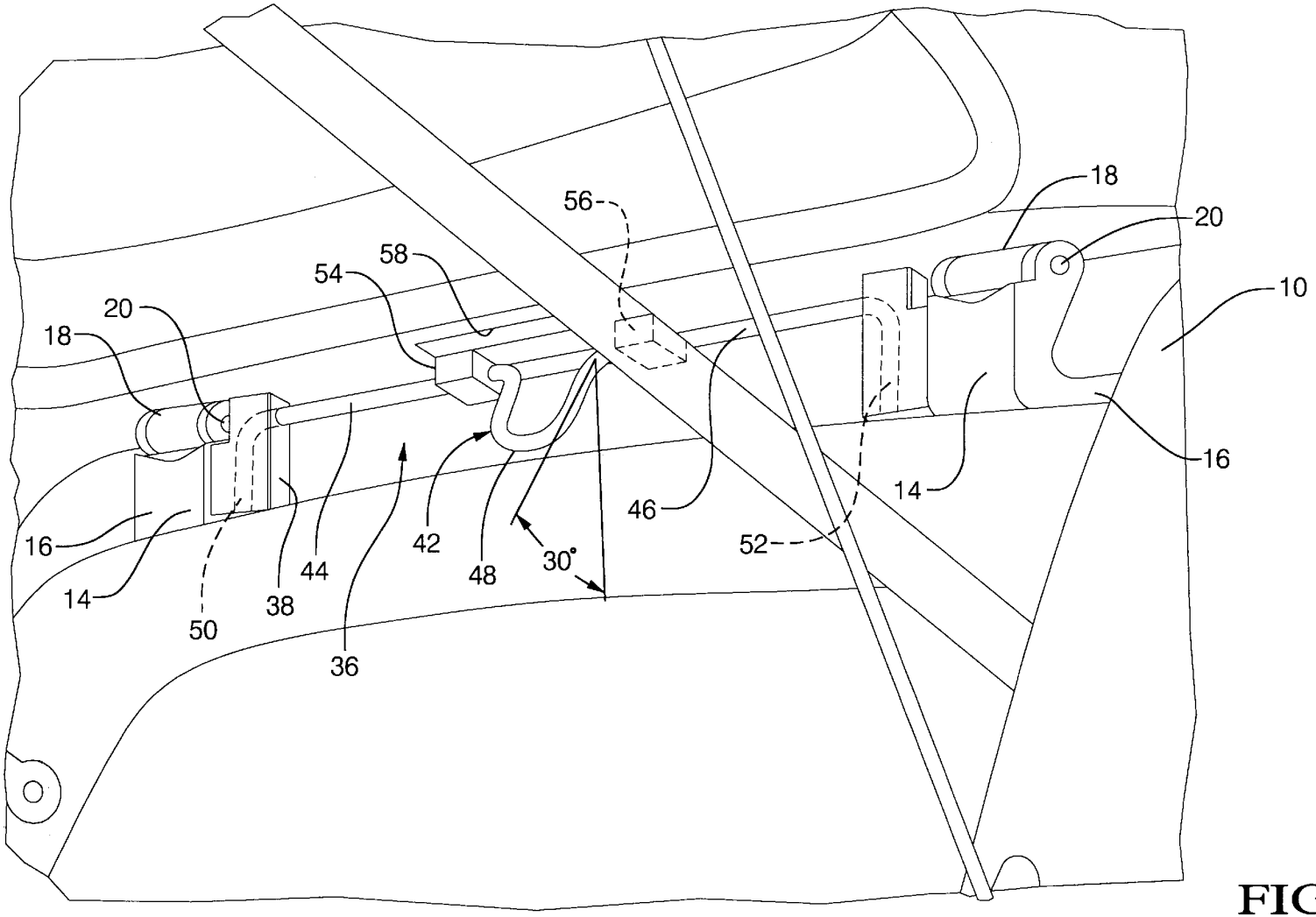
FIG. 2 is an enlarged view of the torsion bar mounted on a vehicle with an open liftgate.

The vehicle 10 has a liftgate 12. Hinge assemblies 14 have hinge portions 16 that are secured to the vehicle 10 and hinge portions 18 that are secured to the liftgate 12. Coaxial pivot pins 20 pivotally attach the hinge portions 18 to the hinge portions 16. The liftgate 12 is generally permitted to pivot about 90° from a closed position to an open position. However, the range of movement can be varied substantially from one vehicle 10 to another.

Two gas cylinders 22 have their cylinder ends 24 pivotally attached to the vehicle door frame 26 by pivot pins 28. The rod ends 30 are pivotally attached to the liftgate 12 by pivot pins 32. The force exerted by the gas cylinders 22 decreases as the rods 30 move out of the cylinders. However, their moment arms increase as the liftgate 12 opens. During the first third of their range of movement (generally about 30°) from the closed position, the gas cylinders 22 may not exert sufficient force on the liftgate to move the liftgate toward the open position. During the last two thirds of their range of movement (generally about 60°), gas cylinders 22 generally exert sufficient force to open the lift gate 12.

The torsion bar assembly 36 includes a first end block 38 attached to the left hinge portion 16 and a second end lock 40 connected to the right hinge portion 16. A torsion bar 42 has a left rod portion 44 and a right rod portion 46 that are joined together in the center by an integral U-shaped loop 48. The outboard end 50 of the left rod portion 44 is inserted into the first end block 38 and bent 90°. The outboard end 52 of the right rod portion 46 is inserted into the second end block 40 and bent 90°. The 90° bends in the outboard ends 50 and 52 of the torsion bar 42 insure that the outboard ends do not rotate relative to the first and second end blocks 38 and 40. Left and right bearing blocks 54 and 56 support the left rod portion 44 and the right rod portion 46 adjacent to the U-shaped loop 48. Both bearing blocks 54 and 56 are secured to the liftgate 12. Left rod portion 44 is coaxial with the pivot pins 20 and is free to rotate in the bearing block 54. Right rod portion 46 is coaxial with the pivot pins 20 and is free to rotate in the bearing block 56.

The plate 58 secured to the liftgate 12 contacts the base of the U-shaped loop 48 when the liftgate 12 is about 30° from the closed position. Continued movement of the liftgate toward the closed position will load the torsion bar 42 and rotate the U-shaped loop 48 about 30° from the ends 50 and 52. The energy stored in the left rod portion 44 and the right rod portion 46 is used to open the liftgate 12 the next time it is unlatched for opening.

A tension cable 60 is pivotally connected to the liftgate 12 by a fastener 62. The cable extends from liftgate 12 to a cable seal 64. The cable then passes through the cable seal and into the inside of a compartment in the vehicle 10. A cable winch inside the vehicle 10 pulls on the cable 60 to close the liftgate 12. The cable winch also maintains tension on the cable 60 as the cable is unwound, to control the rate of movement of the liftgate 12 as the liftgate is opened.

During opening and closing of the liftgate the gas cylinders 22 and the torsion bar assembly 36 cooperate with each other to provide the force required to open the liftgate 12. The torsion bar assembly 36 and the gas cylinders 22 also cooperate to maintain a reasonably constant tension on the cable 60 during opening and closing of the liftgate 12.

The liftgate counter balance system as described is used in connection with a liftgate 12 that moves through an arc of about 90° and that is substantially vertical when in a closed position. The counter balance can be modified slightly by a person skilled in the art to provide similar results when the liftgate 12 moves through an arc that is substantially more than 90° or that is substantially less than 90°. The counter balance system can also be modified to provide similar results when the closed liftgate is generally horizontal rather than vertical.

We claim:

1. A vehicle liftgate counter balance system comprising:

a vehicle frame and an access opening;

a liftgate pivotally attached to the vehicle frame adjacent to the top of the access opening for pivotal movement about a generally horizontal axis;

a pair of gas filled linear actuators with one end of each linear actuator connected to the frame and another end connected to the liftgate and wherein the linear actuators urge the liftgate toward an open position; and a torsion bar connected to the frame and to the liftgate with a portion of the torsion bar coaxial with the generally horizontal axis and wherein the torsion bar exerts a force on the liftgate that urges the liftgate toward an open position only during an initial portion of the liftgate movement between the closed position and the open position.

2. A vehicle liftgate counter balance system comprising: a vehicle having a vehicle body and a door frame integral with the vehicle body that defines a body access opening;

a liftgate pivotally attached to the door frame adjacent to an upper door frame edge for pivotal movement about a generally horizontal axis;

a pair of gas filled linear actuators with a first end of each linear actuator connected to the door frame and a second end of each linear actuator connected to the liftgate and wherein the first and second linear actuators exert force on the liftgate along a pair of lines that pass close to said generally horizontal axis when the liftgate is in a closed position thereby minimizing the force exerted on the liftgate that urges the liftgate toward an open position; and a torsion bar connected to the door frame with a first portion of the torsion bar coaxial with the generally horizontal axis and wherein a second portion of the torsion bar engages the liftgate and exerts a maximum force on the liftgate to urge the liftgate toward an open position when the liftgate is in the closed position and wherein the second portion of the torsion bar disengages from the liftgate as the liftgate moves away from the closed position.

* * * * *